United States Patent [19]

Shamie

[11] Patent Number: 4,703,525

[45] Date of Patent: Nov. 3, 1987

[54] FOLDABLE PLAYPEN FRAME

[76] Inventor: Louis Shamie, 972 Dean St., Brooklyn, N.Y. 11238

[21] Appl. No.: 931,725

[22] Filed: Nov. 14, 1986

[51] Int. Cl.[4] ..... A47C 29/00

[52] U.S. Cl. ..... 5/99 R; 5/99 A; 5/99 C

[58] Field of Search ..... 5/93 R, 98 R, 99 R–99 C, 5/111

[56] References Cited

U.S. PATENT DOCUMENTS

| | | | |
|---|---|---|---|
| 2,498,203 | 2/1950 | Fischer | 5/99 A |
| 2,523,422 | 9/1950 | Dunn | 5/99 C |
| 2,563,446 | 8/1951 | Abel | 5/99 C |
| 2,574,079 | 11/1951 | White | 5/99 C |
| 3,605,139 | 9/1971 | Lorentz, Jr. | 5/99 R |
| 4,008,499 | 2/1977 | Wren, Jr. et al. | 5/99 C |

FOREIGN PATENT DOCUMENTS

| | | | |
|---|---|---|---|
| 1557841 | 2/1969 | France | 5/99 R |

*Primary Examiner*—Gary L. Smith
*Assistant Examiner*—Michael F. Trettel
*Attorney, Agent, or Firm*—Peter C. Michalos

[57] ABSTRACT

A foldable playpen frame includes socket members which are connected together in such a way that they can be brought from a use position with the sockets at the four corners of a square, to a storage position with the sockets lying in a straight line. Four floor support members each have vertical portions extending in one of the four sockets. The floor support members extend outwardly to form an X-shaped floor support when the sockets are in their use configuration, and lie parallel to each other when the sockets are in their storage position. The vertical frame members are also pivotally connected to outside ends of the support members so that fewer parts are needed to form the plate frame.

1 Claim, 19 Drawing Figures

FIG. 7
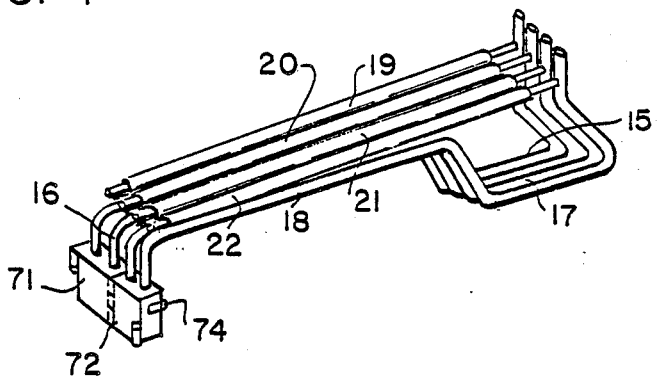
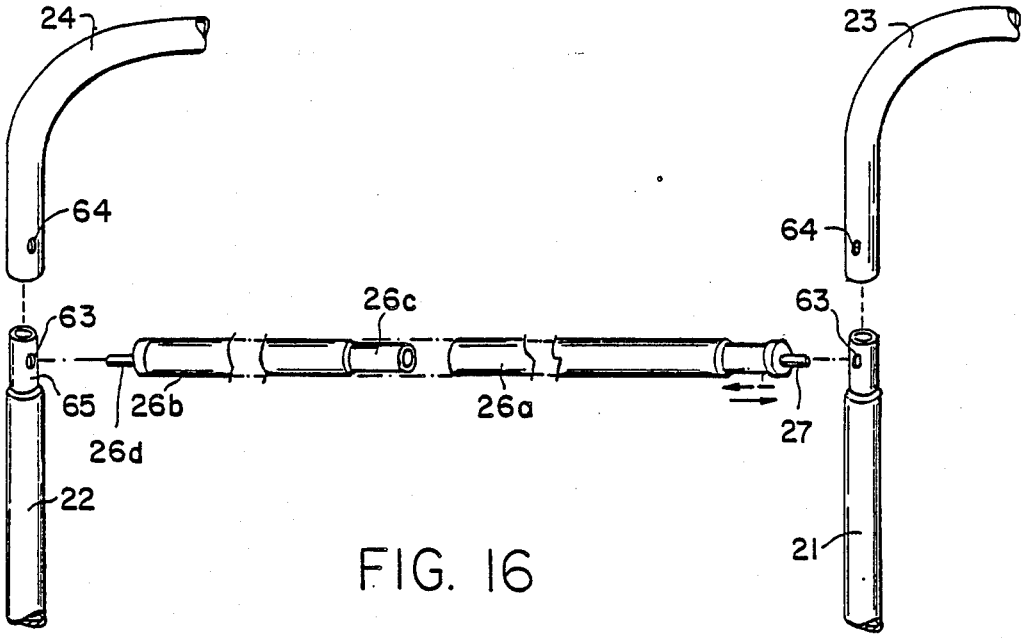
FIG. 16
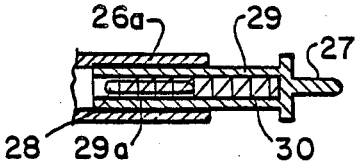
FIG. 17

FOLDABLE PLAYPEN FRAME

FIELD AND BACKGROUND OF THE INVENTION

The present invention relates in general to juvenile furniture, and in particular to a new and useful playpen frame which can be used in conjunction with a playpen cover to form an enclosed playing area for a child, the frame being foldable to a very small volume for storage and transportation.

It is generally advantageous to make playpens foldable for storage and transportation. One approach is to make the playpen out of may parts which can be disassembled for storage. The more parts used, the smaller the final package. A problem exists when using too many parts, however, in that it becomes difficult and complicated to reassemble the playpen.

SUMMARY OF THE INVENTION

The present invention is drawn to a foldable playpen frame which can be folded into a very small package while, at the same time, made of a relatively few number of disassemblable parts.

The fact that few parts are used makes it easier to erect and fold the playpen while at the same time minimizing the risk of losing various parts. By interconnecting multiple parts of the frame as a single sub-assembly, the person having to assemble the frame is relieved of having to decide on how two entirely separate parts must be connected together.

Accordingly, an object of the present invention is to provide a foldable playpen frame which can be deployed into a use position to define a playpen area having opposite ends and opposite sides, which comprise four socket members that are articulated to each other so that they could move from a straight line storage position to a use position where each socket member lies at one corner of a rectangle. Four floor support members each having first vertical portions are engaged with the socket members and can extend out into an X-shaped configuration to support the floor of a playpen. Each of these support members has an opposite vertical portion which extends upwardly and to which an upright can be connected to form the four upright corners of the playpen enclosure. Cross members are connected at opposite ends of the enclosure and between the uprights at those ends to form two upper sides of the enclosure while a pair of side rails are connected between the uprights to form the other two sides of the playpen enclosure.

The frame can be covered by a fabric sleeve which contains floor boards that rest on horizontal portions of the floor support members.

To further minimize the number of separable parts, the uprights are pivotally connected to the second vertical portions of the floor suppport members. In their folded storage positions, the uprights lie parallel to the horizontal portions of the floor support members and the floor support members lie parallel to each other and on one side of the socket members.

A further object of the present invention is to provide a foldable playpen frame which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 7 is a perspective view showing a lower major component of the invention according to the embodiment of FIG. 6 and in a folded condition;

FIG. 16 is an exploded perspective view showing an alternate embodiment for the second cross members;

FIG. 17 is a cross sectional view showing a telescoping end of the cross member of FIG. 16;

DESCRIPTION OF THE PREFERRED EMBODIMENTS

Figure 1:
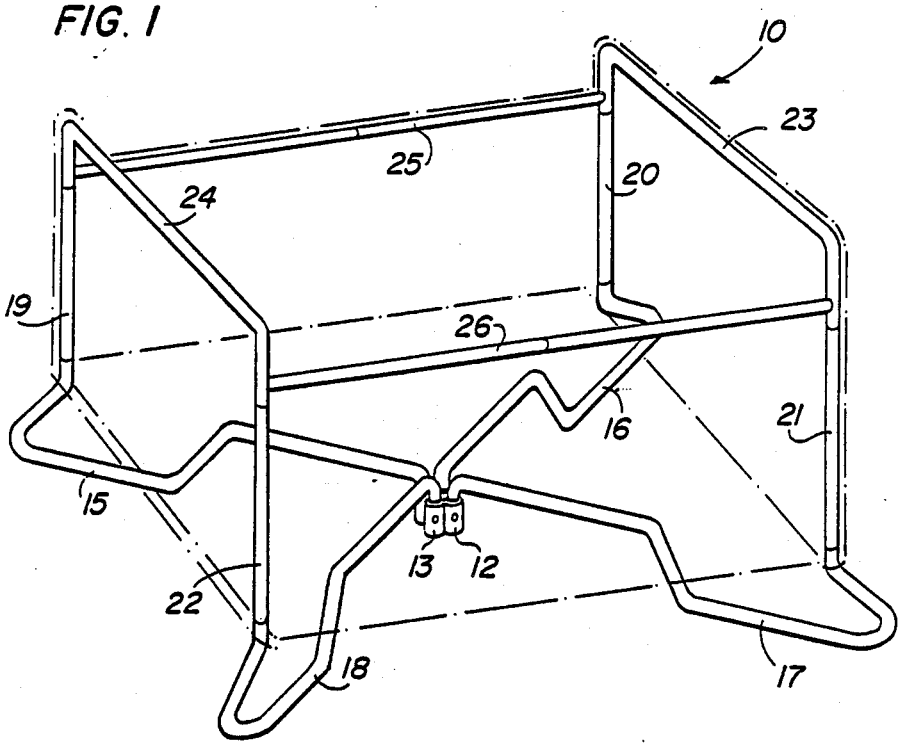
FIG. 1 is a perspective view of the inventive playpen frame in its unfolded use position, the playpen enclosure being shown in phantom line.

Referring to the drawings, the invention embodied in FIG. 1 comprises a foldable playpen frame generally designated 10 which comprises four interconnected socket members 11, 12,13 and 14, two of which are shown in FIG. 1. A floor support member 15, 16, 17 and 18 extends outwardly from each of the socket members to form an X-shaped floor support configuration shown in FIG. 1.

An upright member 19,20,21 and 22 extends upwardly from outer ends of each of the floor support members 15,16,17 and 18 respectively.

The frame 10 in its use position shown in at FIG. 1 defines a playpen space which has opposite ends and opposite sides. A pair of first cross members 23 and 24 are connected between upright members 20, 21 and 19,22, at each end of the playpen enclosure. A pair of second cross members 25 and 26 are connected between the uprights 19,20 and 21, 22, on opposite sides of the enclosure.

Figure 2:
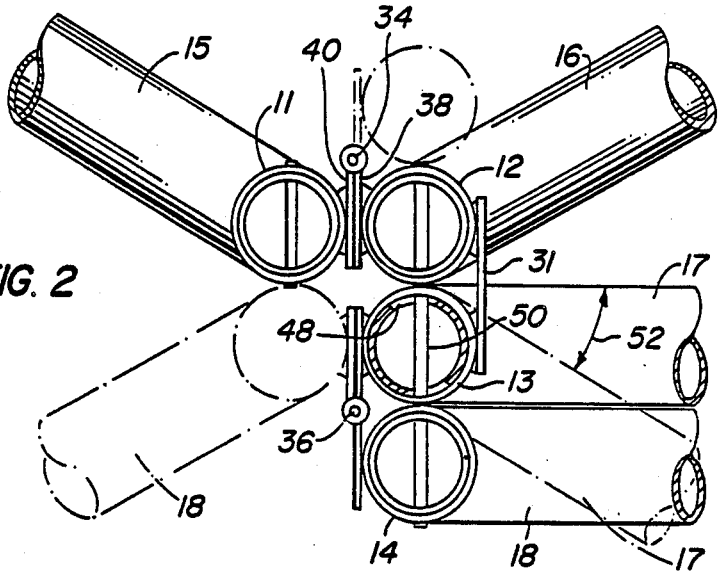
FIG. 2 is a bottom fragmentary plan view of four socket members used to interconnect four floor support members of the playpen frame.

As shown in FIG. 2, two of the socket members 12 and 13 are fixed together by a plate 31 that can be made of metal, just as the socket members 11 through 14, and can thus be welded or soldered to the socket members 12 and 13.

A hinge 34 is connected between socket members 11 and 12 and a hinge 36 is connected between socket members 13 and 14. Each of these hinges provides pivotal movement by at least 90°. In the embodiment of FIG. 2, each hinge 34 and 36 can actually pivot 270°.

Each of the hinges being identical, only one of the hinges will be described in detail.

Hinge 34 has a first hinge plate 38 affixed to socket 12 (again by welding or soldering, for example). Hinge 34 has a second hinge plate 40 which is connected to socket member 11. The upper half of FIG. 2 shows the use position for sockets 11 and 12. In this use position, each of the sockets 11 through 14 lies at one corner of a rectangle. The bottom half of FIG. 2 shows the storage position for the sockets 13 and 14 where all of the sockets would lie in a straight line.

Figure 3:
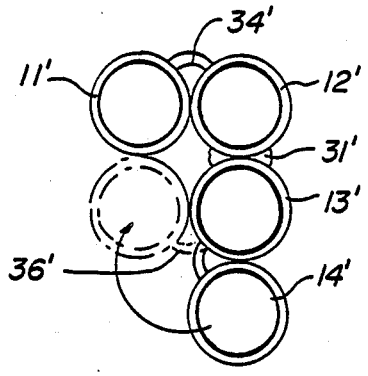
FIG. 3 is a bottom partial plan view showing alternative embodiment for the four socket members.

FIG. 3 shows an alternative embodiment for the hinge means interconnecting the sockets 11',12', 13' and 14'. These sockets can be made of plastic with two of the sockets 12' and 13' being fused together at 31', and flexible projections 34' and 36' forming hinges for pivotally connecting the remaining two sockets 11',14'. In both of FIGS. 2 and 3, the sockets 14 and 14' in their phantom line position show the use position for the socket arrangement.

Figure 4:
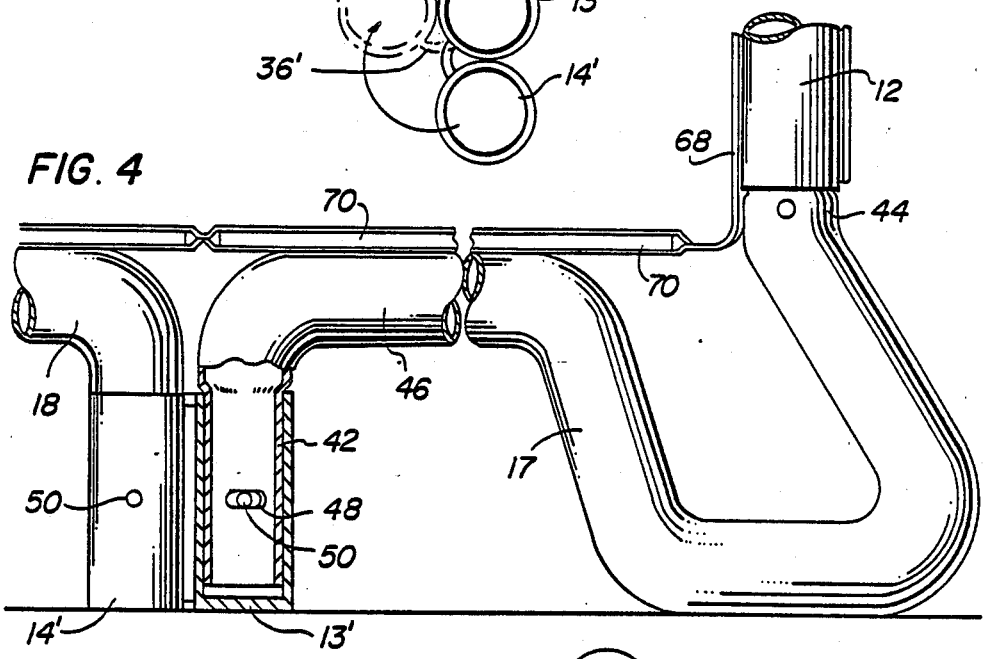
FIG. 4 is a partial, side elevational view, partly in section, showing the unfolded frame with part of the playpen enclosure illustrated.

FIG. 4 shows the embodiment of FIG. 3 used in conjunction with identical parts as in the embodiment of FIG. 2. Two of the floor support members 17 and 18 are shown engaged into the sockets 13' and 14'. Each of the sockets has a substantially vertically extending channel for receiving a first substantially vertical portion 42 of each floor support member 17. Each floor support member being substantially identical, only floor support member 17 will be described in detail. Member 17 has a second substantially vertical portion 44 which is connected to the first portion 42 by a substantially horizontal portion 46. Portion 46 is at least partly at an upper level above the sockets so that it can support floor boards 70 which are articulated together and contained within a fabric enclosure 68.

As shown in FIG. 2, the floor support members 17 can each be pivoted within the channel of their associated socket member by an angle 52 of no more than 45°. This permits the floor support members to be positioned parallel to each other and side by side for a small volume storage configuration. In this storage configuration the socket members 11 through 14 lie in a straight line.

To permit this small amount of pivoting action between the floor support members and their respective socket members, each floor support member at its first portion 42 includes an elongated arcuate slot 48 which receives a pin 50 connected to the socket member and extending through the channel of the socket member.

Figure 5:
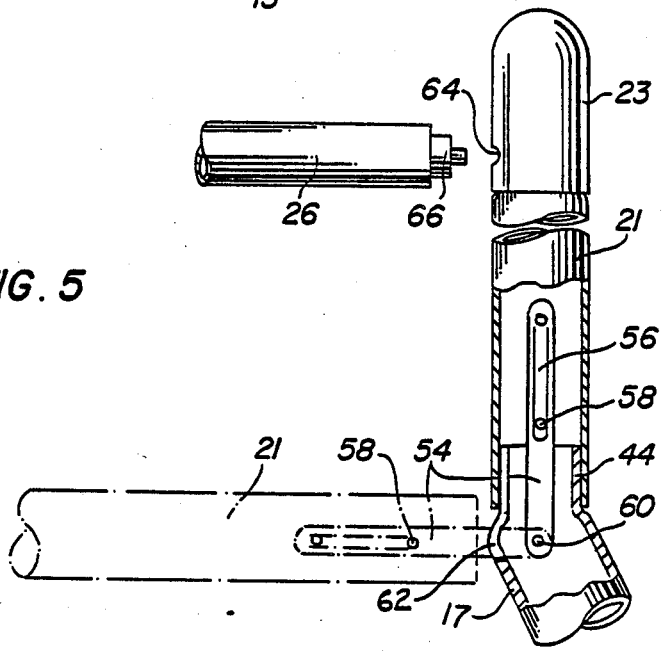
FIG. 5 is a partial, side elevational view, partly in section, showing the interconnection between one upright, its floor support portion and its cross members.
Figure 6:
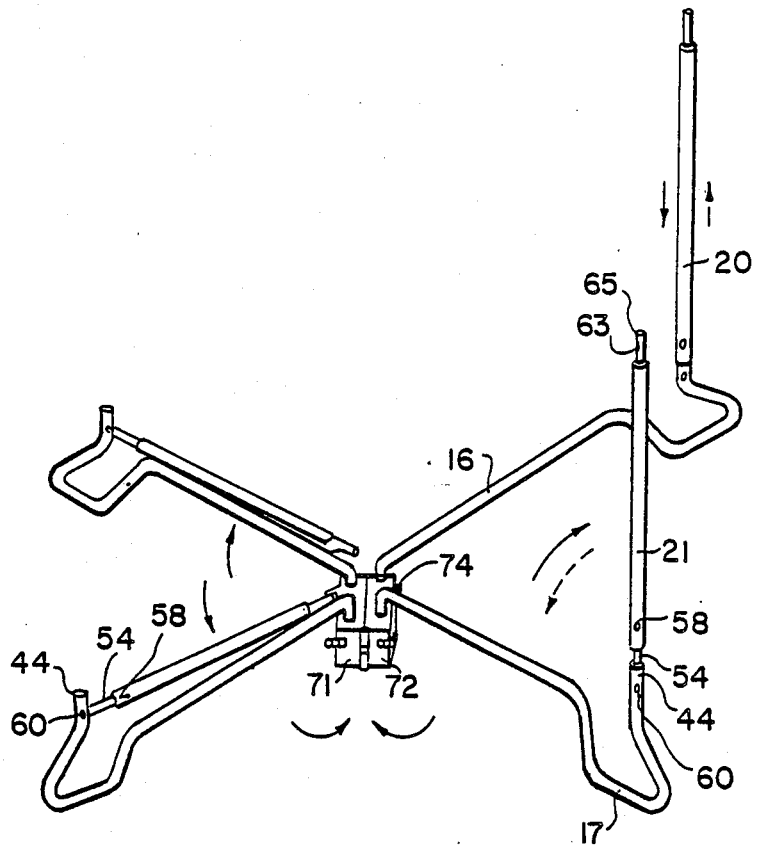
FIG. 6 is a perspective view showing parts of a playpen frame according to another embodiment of the invention.

As shown in FIG. 5, each of the uprights, in this case, upright 21, is pivotally connected to its respective floor support member, in this case 17, so that it can pivot from an upright substantially vertical position shown in solid line in FIG. 5, to a horizontal position shown in phantom line in FIG. 5. In this phantom line storage position, the upright is substantially parallel to the horizontal portion of its floor support member.

To achieve this pivotal action, a plate 54 having one slotted end 56 is pivotally connected at a fixed location 60 to either the floor support portion or the upright. In the case of FIG. 5,fixed pivot connection 60 is a pin fixed to the second portion 44 of floor support member 17. A pin 58 is connected to the upright 21 and extends through slot 56 to permit upward movement of upright member 21. This permits disengagement of a large diameter lower end of member 21, small diameter upper end of portion 44. After disengagement, upright member 21 can be pivoted down into its horizontal position. So that pivot plate 54 can also pivot down without being stopped by the portion 44 of floor support member 17, a slot 62 is provided in the upper end of portion 44 for accommodating pivot plate 54.

Either the first cross member 23 or the upright 21 near its upper end, is provided with a hole 64 which can receive a small diameter post 66 connected to the end of second cross member 26. Small diameter post 66 can be made as a molded part of a plastic fitting which is fitted into the end of cross member 26. As shown in FIG. 1, cross members 25 and 26 are each made of two parts, one part having a small diameter portion and the other having large diameter portion engaged over the small diameter portion. In this way the relatively long cross members 25 and 26 can be reduced to half their length for easy storage.

All of the members 15 through 26 can be made of cylindrical metal tubing for example.

Turning now to FIGS. 6 through 14, an alternate embodiment of the invention is shown wherein two socket members 71 and 72 are hinged together at hinge projections 83 and 84 respectively which are interengaged by a hinge pin 85, and which each carry a pair of socket channels 75 and 76 which receive inner vertical ends of the floor support members 15, 16,17 and 18.

Each socket member 71 and 72 at an end thereof opposite from hinge projection 83 and 84, carry respective latch projections 80 and 78. A latch pin 2 extends downwardly from latch projection 80 and is engagageable in a recess 86 of latch projection 78.

Figure 8:
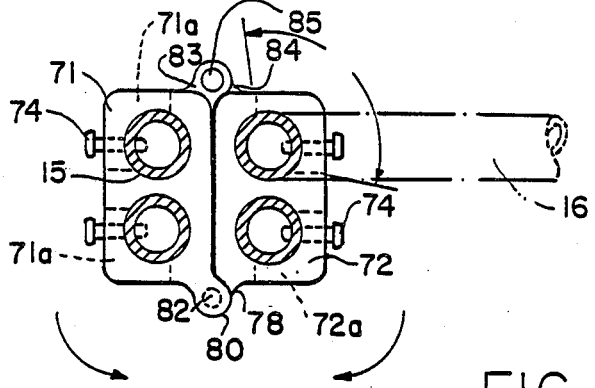
FIG. 8 is a top plan view of the socket members of the embodiment of FIG. 6.

Each of the floor supports 15 through 18, can be pivoted through an angle $\theta$, as shown in FIG. 8. To this end, each of the socket members 71 and 72 have a pair of opposite slots **71*a* and 72*a*. A pin or post 74 is fixed to each floor member and extends outwardly through each slot 71*a* or 72*a*. The slots are shaped so that the pins or posts 74** can pivot through the angle $\theta$.

Figure 11:
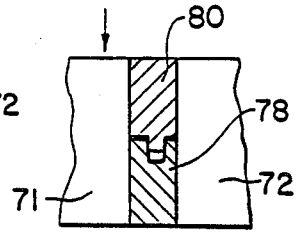
FIG. 11 is a view similar to FIG. 10 showing the latch means engaged for holding the socket members in use position.
Figure 12:
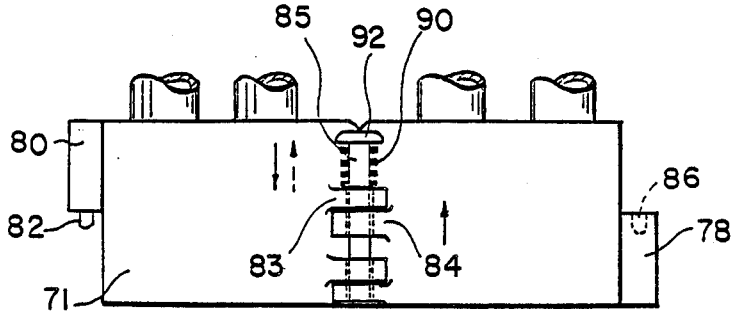
FIG. 12 is a side elevational view showing the socket members of FIG. 8 is their storage position.

As best shown in FIG. 12, a spring 90 is precompressed between a head 92 of pin 85 and the upper hinge projection 83. In this way, socket members 71 and 72 can be moved axially with respect to each other in the direction of the dotted arrow shown in FIG. 10 so that latch pin 82 can be lifted over latch projection 78. As shown in FIG. 11, with the ends of socket members 71 and 72 aligned, they can then move axially in the direction of the arrow in FIG. 11 to engage latch pin 82 into recess 86.

Figure 9:
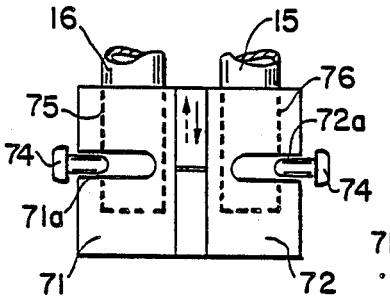
FIG. 9 is a side elevational view of the socket members shown in FIG. 8.
Figure 10:
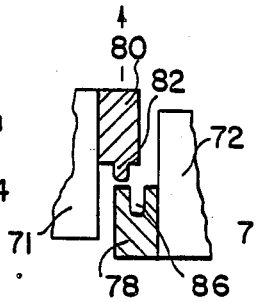
FIG. 10 is a side elevational view showing how one socket member can be moved axially with respect to the other for engaging latch means for holding the socket members in a use position.

FIG. 9 shows the engaged position for the latch projections which together form latch means for holding the socket members 71 and 72 in their use position shown in FIG. 8.

Figure 13:
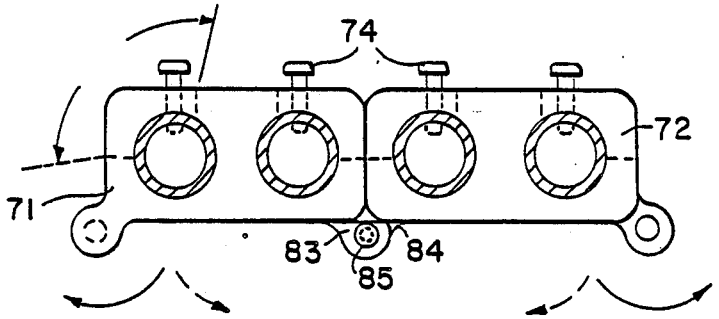
FIG. 13 is a top plan view of the latch member shown in FIG. 12.
Figure 14:
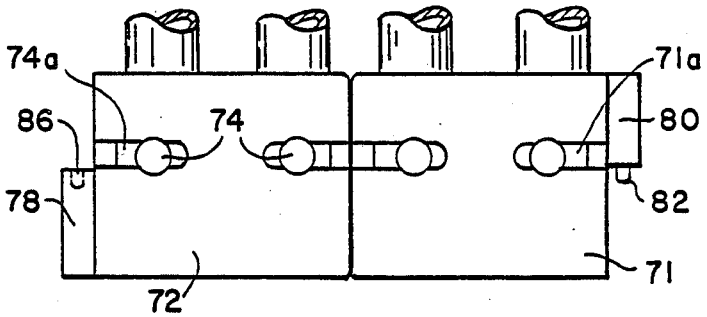
FIG. 14 is a side elevational view showing the latch members on an opposite side from that shown in FIG. 12.

The storage position for the socket members is shown in FIGS. 12, 13 and 14.

The pins or posts 74 each have a head as best shown in FIG. 14 which is outside its respective socket members 71 or 72.

FIG. 7 shows the storage position for this embodiment which is substantially the same as the storage position for the embodiment of FIGS. 1 through 5. In this position, the uprights 19 through 22 lie substantially parallel to the floor supports 51 through 18.

The channels or sockets in socket members 71, 72 lie in a straight line. FIGS. 16 and 17 show an alternate embodiment for the second cross members. The second cross member in FIG. 16 is made up of two lengths of tubing, 26*a* and 26*b*. The lengths 26*b* has a small diameter projection 26*c* which can be engaged into the open end of length 26*a*.

A post 26*d* projects outwardly from one end of length 26*b* and can be engaged into opening 64 in one of the first cross members 24. It is noted that opening 64 can be made to align with an opening 63 in the upper small diameter end 65 of upright 22.

In likewise manner, upright 21 and cross member 23 have alignable openings 63 and 64 which can receive a projection or pin 27 which is mounted to the end ofa telescoping plug 28 which telescopes into and out of the end of length 26*a*. A spring 30 which is positioned inside the hollow plug 29 is prestressed between the element 29 and a pin 28 which extends through and is connected to the length 26*a*. Pin 28 rides in a slot 29*a* of the plug 29 to permit the plug to telescope inwardly. The spring that pushes post 27 outwardly to engage the aligned holes 63 and 64.

Figure 15:
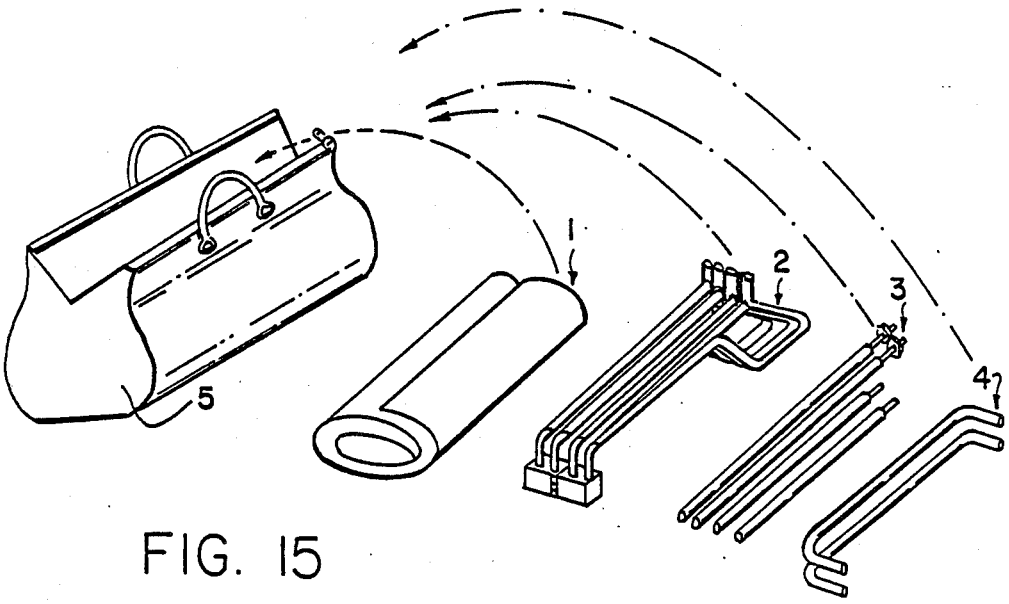
FIG. 15 is a perspective view showing the major components of the playpen frame and playpen enclosure which can be stored in a storage bag for containing all parts of the playpen.

FIG. 15 shows the four major assemblies of the playpen according to the invention. This incldues the soft cover and floor elements which are generally designated 1, the floor portion generally designated 2 and including the folded uprights, the first pair of cross members 4 and the second pair of cross members 3. They can all conveniently fit within a bag 5 whose in FIG. 15. The use of only a few major sub-assemblies makes the erection of the playpen frame particularly easy.

Figure 18:
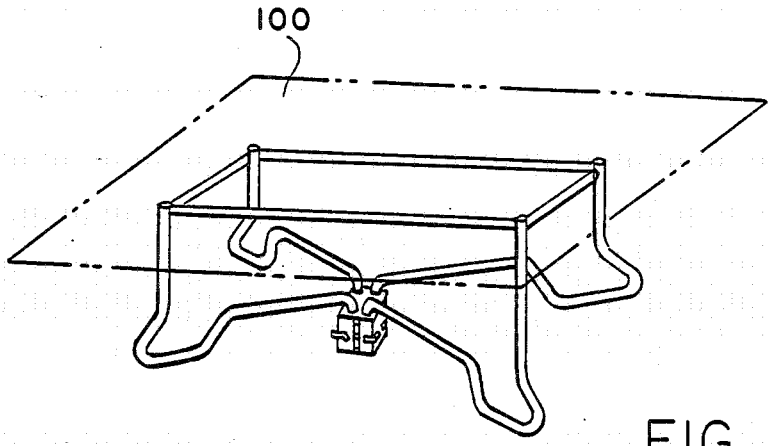
FIG. 18 is a perspective view showing how the playpen frame can be modified to form a base for a table or a platform.

FIG. 18 shows an embodiment of the invention wherein the uprights are made shorter than usual and are interconnected by first and second cross members which are simply fastened between the uprights. The uprights can then support a platform 100 to form a table or the like.

Figure 19:
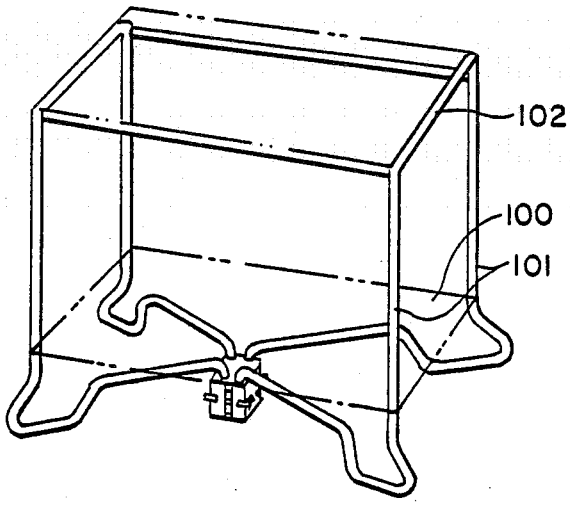
FIG. 19 is a perspective view of an alternate embodiment of the invention wherein the uprights and first cross members are made as single pieces at opposite ends of the playpen frame.

FIG. 19 shows an embodiment of the invention wherein a pair of uprights 101 are made as a single part with a cross member 102 at each end of the playpen frame. Each U-shaped assembly 101, 102 can be otherwise structured similar to the uprights and cross members of the other embodiments of the invention.

While specific embodiments of the invention have been shown and described in detail to illustrate the application of the principles of the invention, it will be understood that the invention may be embodied otherwise without departing from such principles.

What is claimed is:

1. A foldable playpen frame for folding from a use position defining a playpen area having opposite ends and spaced apart opposite sides extending between said opposite ends, to a small volume storage position, comprising:

a plurality of socket members together defining four substantially vertically extending channels;

hinge means interconnecting said socket members for articulation from a storage position with all of said channels lying on a common substantially straight line, to a use position with said channels lying at the corners of a rectangle;

four floor support members each having a first substantially vertical portion at one end, a second substantially vertical portion at an opposite end and a substantially horizontal floor support portion connected between said first and second vertical portions, each first portion of each floor support member being engaged in one of said channels of one of said socket members, said horizontal portions extending outwardly from said socket members in their use position to form an X-shaped floor support, said horizontal portions extending parallel to and adjacent each other in said storage position of said socket members;

an upright member connected to each second vertical portion of each floor support member;

a pair of first cross members each connected between two upright members at one of said opposite ends of said frame in its use position, there being one first cross member at each of said opposite ends of said frame in said use position; and a pair of second cross-members each connected between two upright members on one of said opposite sides of said frame in its use position, there being one of said second cross members at each of said opposite sides of said frame in its use position.

2. A playpen frame according to claim 1, wherein said hinge means comprises a hinge connected between two of said socket members, said hinge permitting pivoting of one of its socket members by at least 90°.

3. A playpen frame according to claim 2, wherein said first substantially vertical portion of each floor support member is pivotally mounted to one of said socket member.

4. A playpen frame according to claim 3, wherein each first substantially vertical portion of said floor support members is pivotally mounted to one of said socket members for pivoting by 45° at most.

5. A playpen frame according to claim 4, wherein each of said upright members is pivotally mounted to said second substantially vertical portion of one of said floor support members for movement from a vertical use position to a horizontal storage position, said upright member being substantially parallel to said substantially horizontal floor support portion in its storage position.

6. A playpen frame acording to claim 5, including a pivot plate pivotally mounted at a fixed location to one of said upright member and second portion to which said upright member is pivotally connected, said pivot plate having an end opposite said fixed location with a slot therein, and a pin connected to the other of said upright member and second portion, said pin extending through said slot of said pivot plate, said one of said upright member and second portion having a further slot for receiving said plate with said upright member in its storage position, one of said upright member and second portion having a small diameter end, the other of said upright member and second portion having a larger diameter end engaged over said small diameter end in said use position of said upright member whereby said upright member is movable away from said second portion for disengaging said small and large diameter ends, and pivotal to move said upright member into its storage position.

7. A playpen frame according to claim 6, wherein each of said pair of second cross members has a small diameter post at both ends thereof, each of said pair of first cross members having holes therein for receiving said small diameter post.

8. A playpen frame according to claim 1, wherein each of said upright members is pivotally mounted to said second substantially vertical portion of one of said floor support members for movement from a vertical use position to a horizontal storage position, said upright member being substantially parallel to said substantially horizontal floor support portion in its storage position.

9. A playpen frame according to claim 8, including a pivot plate pivotally mounted at a fixed location to one of said upright member and second portion to which said upright member is pivotally connected, said pivot plate having an end opposite said fixed location with a slot therein, and a pin connected to the other of said upright member and second portion, said pin extending through said slot of said pivot plate, said one of said upright member and second portion having a further slot for receiving said plate with said upright member in its storage position, one of said upright member and second portion having a small diameter end, the other of said upright member and second portion having a larger diameter end engaged over said small diameter end in said use position of said upright member whereby said upright member is movable away from said second portion for disengaging said small and large diameter ends, and pivotal to move said upright member into its storage position.

10. A playpen frame according to claim 1, wherein each of said pair of second cross members has a small diameter post at both ends thereof, each of said pair of first cross members having holes therein for receiving said small diameter posts.

11. A playpen frame according to claim 1, including two socket members each including two vertically extending channels, each socket member having one side connected to the other socket member by said hinge means, and latch means on the opposite sides of each socket member for holding said socket members together in their use position.

12. A playpen frame according to claim 11, wherein each of said socket members has a slot therein, and a post connected to said first vertical portion of each floor support member, each post extending in said slot and being movable in said slot to permit pivoting of each floor support member on its respective socket member.

13. A playpen frame according to claim 11, wherein said latch means comprises a first latch projection on one of said socket members having a recess therein and a second latch projection on the other of said socket members having a latch post therein, said latch post being engageable in said recess for holding said socket members in their use position, said hinge means including a hinge projection extending from each of said socket members, said hinge projections having aligned holes therethrough, a hinge pin extending through said aligned holes and a spring engaged between said socket members and said hinge pin for permitting axial movement of one socket member with respect to the other socket member.

14. A playpen frame according to claim 1, including four socket members each including one of said vertically extending channels, a plate connecting two of said socket members together, said hinge means comprising a first hinge pivotally connecting a third one of said socket members to one of said interconnected socket members and a second hinge for pivotally connecting a fourth one of said socket members to the other of said interconnected socket members.

15. A playpen frame according to claim 1, wherein one of said first cross members and two of said uprights at one end of said playpen frame together form a single element.

* * * * *